US006041560A

United States Patent [19]

Larson et al.

[11] Patent Number: 6,041,560

[45] Date of Patent: Mar. 28, 2000

[54] VARIABLE WIDTH SILL SUPPORT

[75] Inventors: John A. Larson, Parkland, Fla.; Thomas J. Gretz, Clarks Summit; John Ofcharsky, Olyphant, both of Pa.

[73] Assignee: Plastic Components, Inc., Miami, Fla.

[21] Appl. No.: 09/156,718

[22] Filed: Sep. 18, 1998

[51] Int. Cl.[7] ..... E06B 3/30

[52] U.S. Cl. ..... 52/204.54; 52/204.1; 52/212; 49/468; 49/505

[58] Field of Search ..... 52/212, 204.54, 52/204.1, 60, 97; 49/468, 505, 504

[56] References Cited

U.S. PATENT DOCUMENTS

| | | | |
|---|---|---|---|
| 1,890,672 | 12/1932 | Coco | 52/204 |
| 1,910,260 | 5/1933 | Reher | 52/204 |
| 2,697,932 | 12/1954 | Goodwin | 52/204 |
| 2,734,602 | 2/1956 | Dawson | 52/212 |
| 4,555,882 | 12/1985 | Moffitt et al. | 52/204 |
| 5,136,814 | 8/1992 | Headrick | 49/468 |
| 5,611,173 | 3/1997 | Headrick et al. | 52/204.1 |
| 5,673,517 | 10/1997 | Stanclift | 49/468 |
| 5,802,785 | 9/1988 | Crook | 52/204.54 |

*Primary Examiner*—Carl D. Friedman
*Assistant Examiner*—Dennis L. Dorsey

[57] ABSTRACT

A sill support for protecting the sill of a window or door in new or retrofit construction which minimizes the need for on-site fabrication and comprises left and right end dam sections that engage a center connecting member of variable length depending upon the width of the door or window opening being treated.

6 Claims, 4 Drawing Sheets

VARIABLE WIDTH SILL SUPPORT

FIELD OF THE INVENTION

The present invention relates generally to devices for inhibiting the penetration of water into the interior of buildings at the bottom of window and door openings. More specifically, the present invention relates to flexible, variable width sill protection units which, because of their design, can be readily installed in window and door openings of varying width with minimal on-site adjustment or fabrication.

BACKGROUND OF THE INVENTION

Permeation of water into buildings at the base or sill of window and door openings has long been a problem for both new and retrofit construction. Innumerable systems have been designed to solve this problem, but the most common remains the on-site fabrication, generally from metal, of a suitably shaped pan that fits over the sill and directs the flow of impinging water off of the sill. It is necessary that such fabrication be done on-site because of the large number of different widths in which windows and doors are supplied. Such on-site fabrication is both expensive and time consuming.

There has consequently been a long standing need for a readily adjustable door and window sill device which performs the function of inhibiting water permeation while being readily installable in the field with a minimum of on-site fabrication.

U.S. Pat. No. 4,555,882 to Moffitt et al issued Dec. 3, 1985 describes one such moisture guard which is designed to fit under the sill of a door or window. In one embodiment, right- and left-handed moisture guard sections, each having a vertical end wall which engages the frame of the window or door opening, are overlapped to provide a full width moisture guard for door and window openings of varying width. While this Patent describes a significant improvement over conventional on-site fabricated moisture guard systems, it has at least one significant constraint, namely, individual moisture guard sections that are overlapped must be made extremely long to accommodate wide as well as narrow openings. In the case of a narrow opening, it will be necessary to throw away significant useful material which has been fabricated to include end walls, if the sections are made long enough to accommodate very wide openings in the overlap configuration.

The moisture guard or sill support of the present invention, on the other hand, provides a flexible system that yields maximum usage of prefabricated materials with a similar minimal need for on-site fabrication.

SUMMARY OF THE INVENTION

According to the present invention there is provided an improved sill support for new or retrofit construction comprising left and right end dam sections which engage a center connecting member of varying length depending upon the width of the door or window opening being treated. According to a preferred embodiment, the end dam sections include upright end flanges and a horizontal base which has longitudinal female grooves formed into its upper surface and the center connecting member has, on its lower or end dam engaging surface, longitudinal male ridges which engage and lock into the female grooves. According to another preferred embodiment, the horizontal surface of the end dam sections is slanted downward at an angle of about 20 degrees to insure that water impinging thereon drains off. Yet another preferred embodiment of the present invention provides for end dam sections whose upright end portions include a female groove that engages directly the left and right extremities of the center connecting member. A further preferred embodiment of the present invention includes a flange extending downward from the front edge of the center connecting member at an angle greater than 90 degrees. A final preferred embodiment includes a drip edge extending outward at an angle of about 45 degrees from downward extending flange.

DESCRIPTION OF THE DRAWINGS

The present invention will be more fully understood from the detailed description given hereinbelow and the accompanying drawings which are given by way of illustration only, are not intended to be limitative and wherein like numerals refer to like elements.

DETAILED DESCRIPTION

Figure 1:
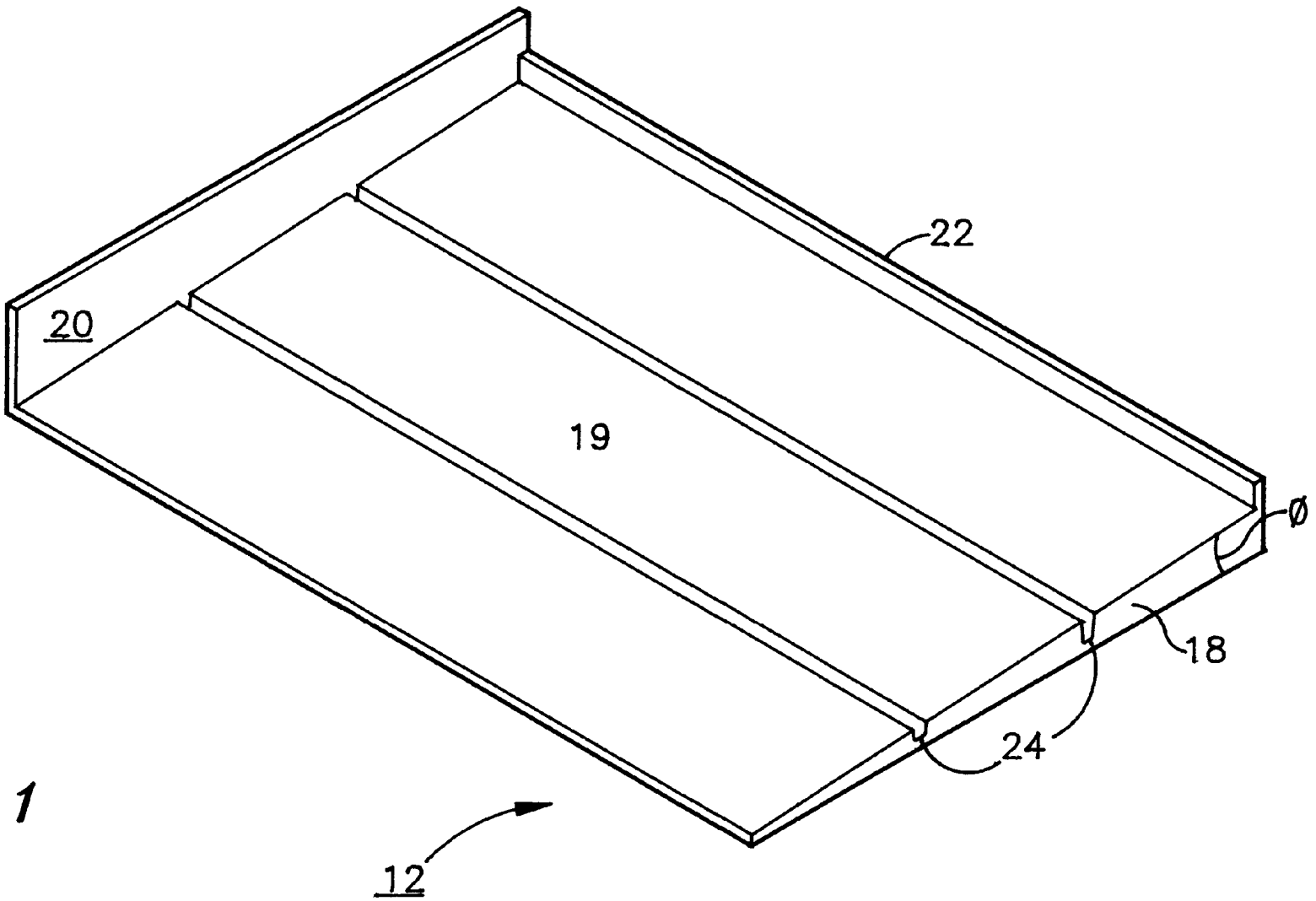
FIG. 1 is a perspective view of one embodiment of the left end dam of the sill support of the present invention.
Figure 3:
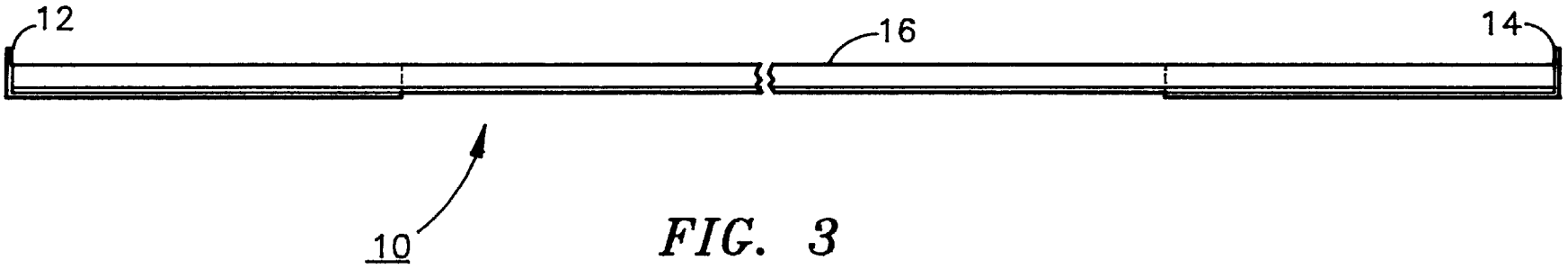
FIG. 3 is a front view of the sill support of the present invention in its assembled configuration.

As shown in FIG. 3, the preferred sill support 10 of the present invention comprises a left end dam 12, a right end dam 14 and a center connecting member 16. End dams 12 and 14 are mirror images of each other and the elements thereof are common to both. According to a preferred embodiment shown in FIG. 1, each of end dams 12 and 14 comprises a generally wedge-shaped base 18, an upstanding end flange 20, and at the rearward edge of base 18, an integrally formed upstanding rear flange 22. End flange 20 and rear flange 22 may be of the same or different heights depending upon the particular application. According to a preferred embodiment, end flange 20 is about ¾" high and rear flange 22 is about ½" high. Into upper surface 19 of base 18 are formed longitudinal female grooves 24. Because of the wedge shape of base 18, upper surface 19 is slanted from true horizontal to allow for adequate water drainage. Angle ø is preferably about 20 degrees.

Figure 2:
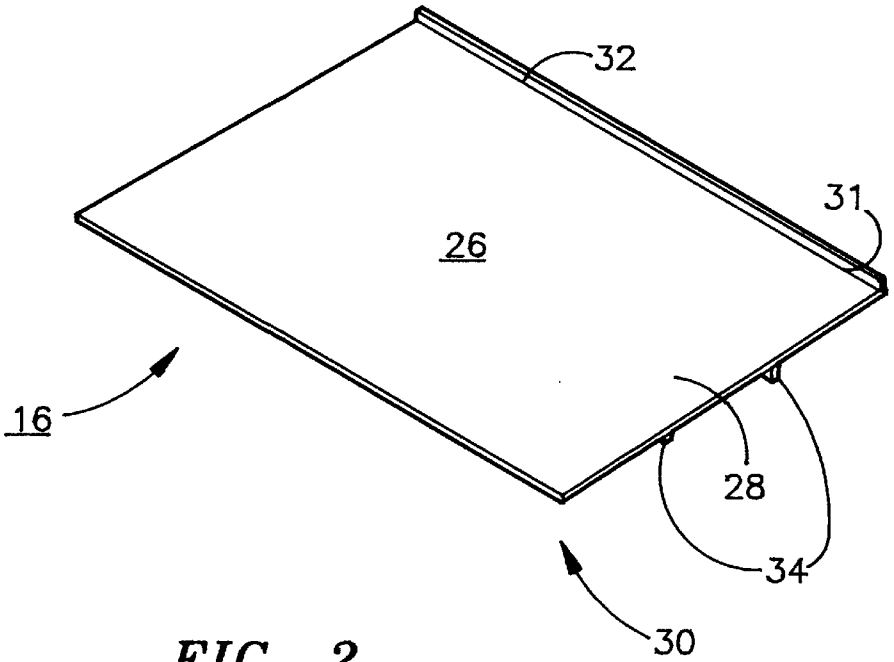
FIG. 2 is a perspective view of the center connecting section of the sill support of the present invention.

As shown in FIG. 2, center connecting member 16 comprises a base 26 which has upper and lower surfaces 28 and 30 respectively. Extending from the rearward edge of upper surface 28 is upstanding flange 32 that is generally coextensive with or slightly shorter than upstanding flange 22 of end dams 12 and 14. Extending from lower surface 30 of center connecting member 16 are longitudinal male ridges 34 which are designed and sized to engage female grooves 24 in base 18 of end dams 12 and 14.

Figure 5:
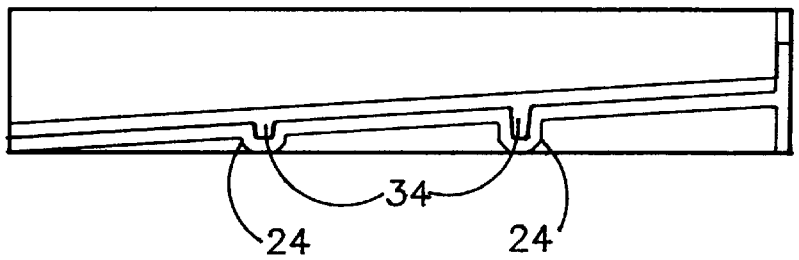
FIG. 5 is a sectional view of a center connecting member engaged with an end section of the sill support of the present invention.

When end dams 12 and 14 are assembled to center connecting member 16, as shown in FIG. 5, male ridges 34 engage female grooves 24 to provide a secure fit and prevent any relative movement between the individual pieces of sill support 10.

Depending upon the particular design of the sill support of the present invention, it may be desirable that at the point 31 where upstanding flange 32 and upper surface 28 of center connecting member 16 meet, that upstanding flange 32 be scored or otherwise weakened so that when upon installation of center connector 16 to end dams 12 and 14 upstanding flanges 28 and 22 interfere, a portion of upstanding flange 28 may be simply removed by tearing or otherwise.

Figure 6:
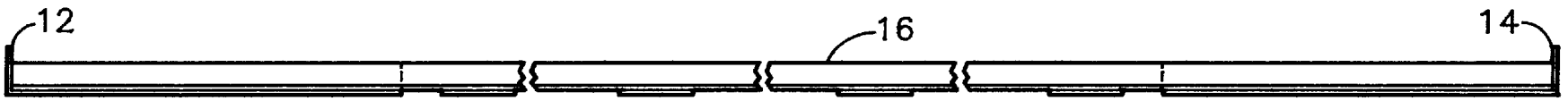
FIG. 6 is a front view of the sill support of the present invention installed in a very wide window or door opening.

For very wide window or door sill installations, as shown in FIG. 6, shims or supports 36, having the same general configuration as base 18 of end dams 12 and 14, may be inserted under the extended center connecting member 16, required for such installations, to provide support therefor. Generally, insertion of shims 36 every 18–24 inches is adequate to provide the required support.

Since it is preferred, because of manufacturing costs and other economic reasons, that the sill support of the present invention be fabricated from vinyl or some similar polymeric material, it is possible to manufacture center connecting member 16 in very long or standard lengths or even to manufacture it in coil form from which any required length may be cut on site, thus minimizing greatly any wasted material resulting from variations in window or door width.

Figure 4:
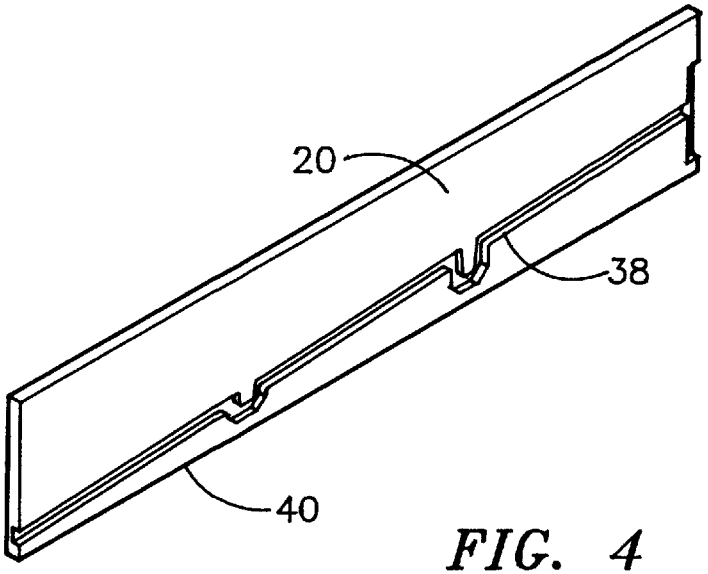
FIG. 4 is a side view of an alternative embodiment of a left end dam of the sill support of the present invention.

Another alternative embodiment of the sill support of the present invention is depicted in FIG. 4. As shown in this figure, base 18 of end dam 12 is eliminated, rear flange 22 shortened in length and a slot 38 integrally formed in the inside face 40 of end flange 20. In this embodiment, upon assembly, center connecting section 16 is inserted into slot 38 which is preferably, but not necessarily, provided with integrally formed indents 42 for receipt of ridges 34 of center connecting section 16. Slot 38 should be of the same general configuration as the cross section of center connecting section 16 to assure a close and secure fit of the two pieces.

Figure 7:
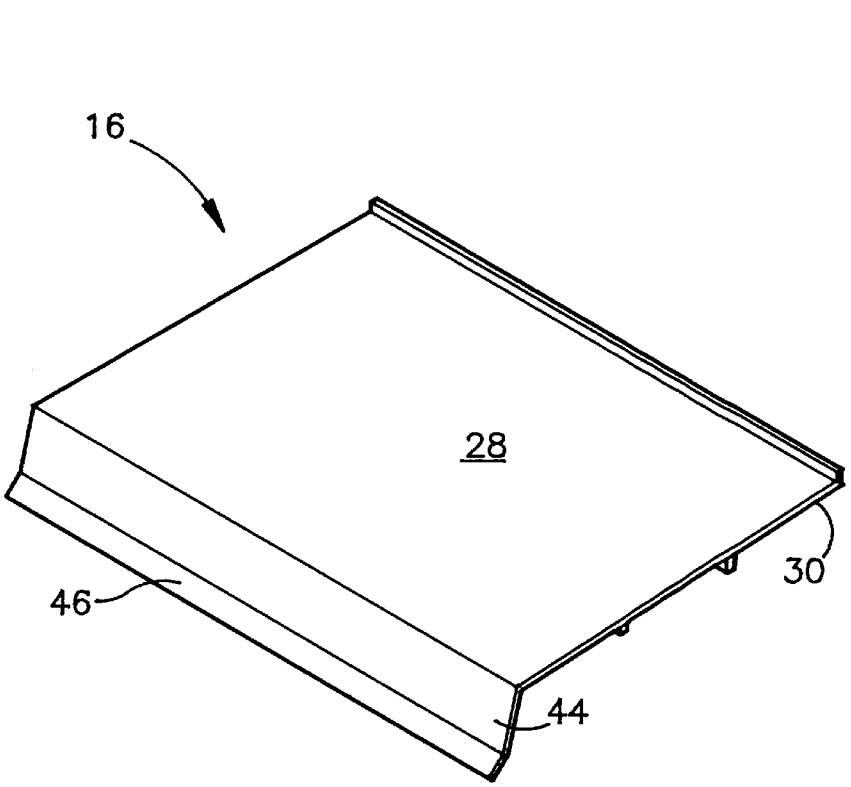
FIG. 7 is a perspective view of a further preferred embodiment of the present invention that includes a downward extending flange at the front edge of the center connecting member.

In the yet further preferred embodiment of the present invention, depicted in FIG. 7, center connecting member 16 includes a flange 44 extending downward from its front edge at an angle less than about 90 degrees from upper surface 28 of connecting member 16. To further insure that water impinging on upper surface 28 of center connecting member 16 is properly diverted away from the structure below the window or door, another flange 46 extends downward from the forward edge of flange 44 at an angle of about 45 degrees. The addition of flanges 44 and 46 is of course optional to the successful practice of the present invention.

As the invention has been described, it will be apparent to those skilled in the art that it may be varied in many ways without departing from the spirit and scope of the invention. Any and all such modifications are intended to be included within the scope of the appended claims.

What is claimed is:

1. A sill support system comprising:

A) left and right end dam sections that are mirror images of each other and each comprise:
   1) a base having an upper and a lower surface, a front and a rear longitudinal edge and a left and a right extremity,
   2) an upright end flange extending upward at a generally right angle from the base at one of the left or right hand extremities of each of the left and right hand end dams,
   3) longitudinal grooves in the base upper surface, and
   4) an integrally formed upstanding rear flange extending from the rear longitudinal edge of the of the left and right end dams; and B) a center connecting member comprising:
   1) a base having an upper and a lower surface and a front and a rear longitudinal edge;
   2) longitudinal ridges in the center connecting member base lower surface that engage the longitudinal grooves in the left and right end dam base upper surfaces upon overlap of the center connecting member base with the left and right end dam bases.

2. The sill support system of claim 1 wherein the left and right end dam upper surfaces are slanted about 20 degrees upward from their front longitudinal edges.

3. The sill support system of claim 1 further including at least one shim of the same general configuration as the left and right end dam bases inserted under the center connecting member.

4. The sill support of claim 1 further including a downstanding flange extending at an angle of less than about 90 degrees from the front longitudinal edge of the center connecting member base.

5. The sill support system of claim 4 further including a drip edge extending downward from the downstanding flange at an angle of about 45 degrees.

6. The sill support system of claim 1 wherein the center connecting member includes an upstanding flange that extends along the rear longitudinal edge.

* * * * *